United States Patent [19]

Dempsey et al.

[11] 4,245,219

[45] Jan. 13, 1981

[54] TREADLE ALARM SYSTEM

[76] Inventors: Gene M. Dempsey, 2095 Surrey Trail, College Park, Ga. 30349; Jack M. Dempsey, 2669 Cardinal Lake Cir., Duluth, Ga. 30136

[21] Appl. No.: 41,946

[22] Filed: May 24, 1979

[51] Int. Cl.[3] ..... G08B 13/10

[52] U.S. Cl. ..... 390/666; 200/61.93; 200/86 R; 340/541

[58] Field of Search ..... 340/666, 568, 541; 200/86 R, DIG. 35, 61.93

References Cited

U.S. PATENT DOCUMENTS

| | | | |
|---|---|---|---|
| 918,413 | 4/1909 | Anderson, Jr. | 200/86 R |
| 2,783,327 | 2/1957 | Luckey | 340/666 |
| 4,080,519 | 3/1978 | Michalson | 200/86 R |

*Primary Examiner*—Glen R. Swann, III

*Attorney, Agent, or Firm*—Newton, Hopkins & Ormsby

[57] ABSTRACT

An alarm system embodied in a treadle pad is biased open and can be closed by the application of pressure on the pad or by the removal of weight from it in another mode. Closing of the alarm switch relays an electrical signal through a control unit to actuate a d.c. powered audible or visual signal. The device has many practical applications and features simplicity and economy.

5 Claims, 5 Drawing Figures

TREADLE ALARM SYSTEM

BACKGROUND OF THE INVENTION

Many electrical alarms including intrusion alarms for homes and businesses are known in the prior art. Some of the prior art alarm systems include weight-responsive or pressure-responsive elements including pads or treadles. Among the drawbacks present in the known prior art are excessive cost of manufacturing due to complexity of construction and lack of power supplies.

Known prior U.S. Pat. Nos. are made of record below to satisfy the requirements of disclosure under 37 C.F.R. 1.56:

| | |
|---|---|
| 425,143 | 3,604,958 |
| 2,474,157 | 3,685,037 |
| 2,625,621 | 3,867,595 |
| 2,694,803 | 3,893,095 |
| 3,594,760 | 3,991,415 |

Among the objectives of this invention is to provide an alarm system of simplified and economical construction which will power alarm signal devices.

Another object is to provide a treadle operated alarm which is sensitive to human or animal intrusion on premises where the alarm is installed, such as outside the door of a home or apartment, a place of business or other shelter which is not equipped with a regular door bell. The invention can also be used in a store to signal the removal of an article from a support containing the alarm switch. Many other applications of the invention are feasible.

The principal advantage of the invention over the known prior art can be summarized as follows:

(1) It is entirely practical and inexpensive to manufacture and install.

(2) It is highly versatile and can be installed by anyone without the use of tools.

(3) For home use, the invention can be embodied in a decorative door mat.

(4) It can be made in a variety of sizes for a large range of installations with electrical extension cords of any length so that the treadle pad can be placed any desired distance from the alarm signal device.

Other objects and advantages of the invention will become apparent during the course of the following description.

DETAILED DESCRIPTION

Figure 1:
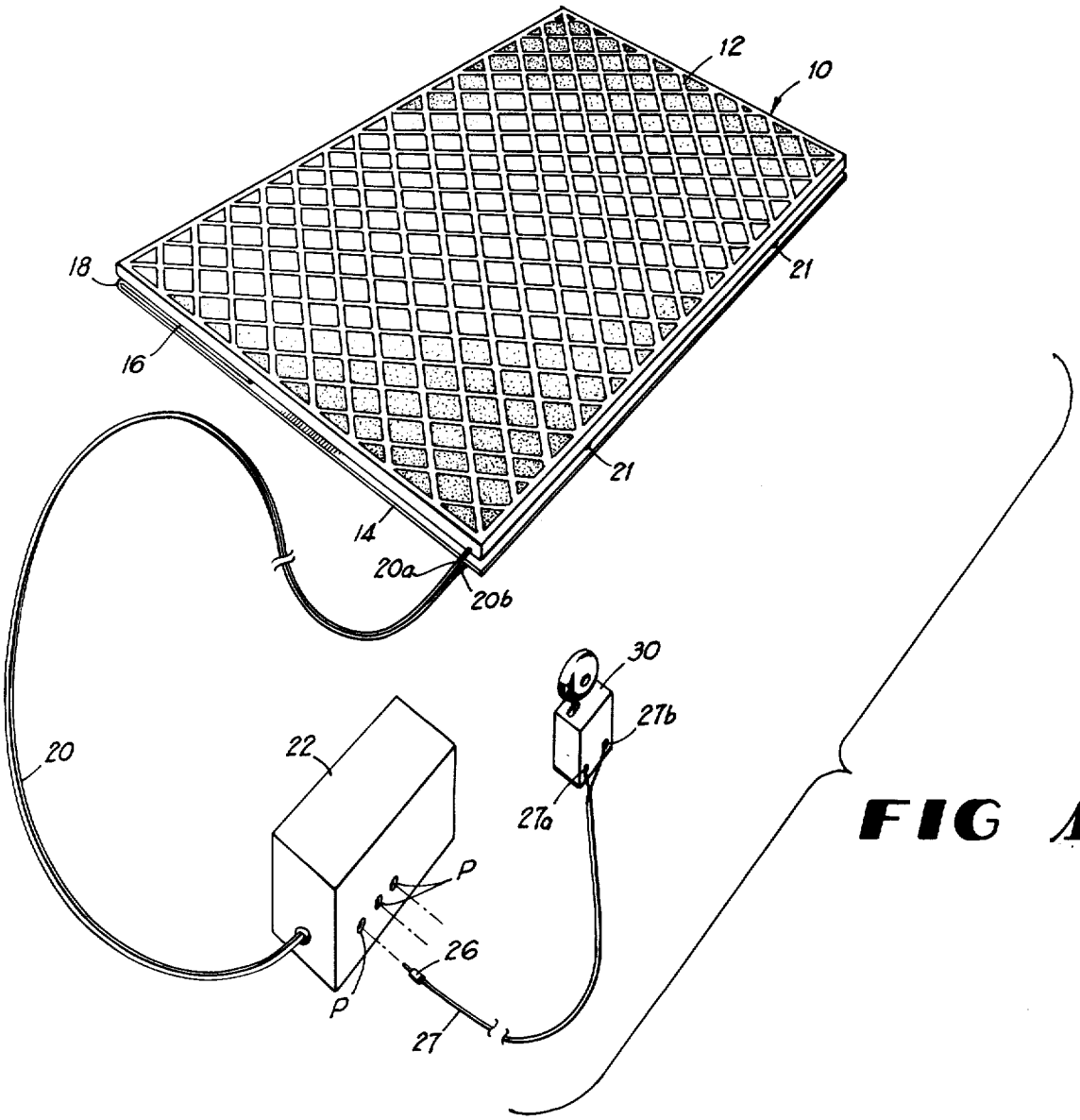
FIG. 1 is an exploded perspective view of one preferred embodiment of the invention.

Referring now in detail to the embodiments chosen for the purpose of illustrating the present invention, numeral 10 denotes generally an electrical switch treadle device which is in the form of a doorway mat for the home or a business establishment. This treadle device includes a pair of opposed panels 12 and 14 which are joined along a common transverse edge forming a yieldable or resilient spring hinge 18 so that the upper panel 12 is suspended in cantilever fashion over the lower panel 14, and is supported in spaced relationship thereto, but can be depressed toward lower panel 14.

In more detail, the upper panel 12 includes a flat rectangular rigid step pad which is waffled along its upper surface and preferably is formed from a dielectric or electrically insulating material, such as hard rubber or resinous plastic. The pad 12 is sufficiently rigid that it maintains its shape, being supported solely along its rear edge portion. The lower panel 14 is a flat rectangular sheet metal, electrically conducting base plate which is shown as being coextensive in size and shape with the step pad 12. The hinge 18 can also be from the sheet metal and is integrally joined to the rear edge portion of the base plate 14. Hinge 18 is reversely bent so as to form a U-shaped transversely extending hinge edge. Integrally joined to the upper portion of the hinge 18 is a smaller sheet metal rectangular pad supporting plate 16 which is of the same transverse width as the plate 14. The supporting plate 16 extends a short distance over the plate 14 so as to overlie the rear edge portion of plate 14.

The bottom rear edge portion of the pad or panel 12 is secured to the upper surface of plate 14 by a bonding with adhesive or the like. The pad 12 is, therefore, yieldably supported by the hinge 18 in cantilever fashion over and spaced from the plate 14.

A cable 20 of any required length extends from the treadle device 10, the cable 20 having wires **20*a* and 20*b*. The wire 20*a* is embedded in the forward end portion of the step pad 12 while the proximal end of the wire 20*b* is electrically connected to the conducting base plate 14**.

Figure 2:
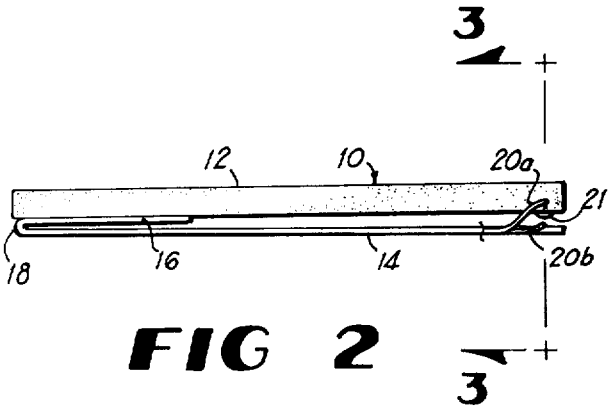
FIG. 2 is a side elevation of a treadle pad or mat forming an element of the invention.
Figure 3:
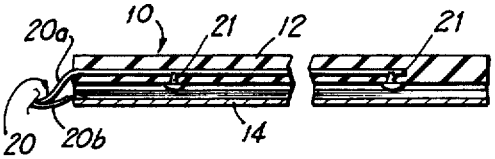
FIG. 3 is a fragmentary vertical section taken on line 3-3 of FIG. 2.

As best seen in FIGS. 2 and 3, the proximal end portion of wire **20*a* extends across the frontal edge portion of the step pad 12 and is electrically connected to a pair of transversely spaced downwardly protruding contact elements 21, the shanks of which are embedded in pad 12 and the rounded heads of which protrude below the lower surface of the treadle pad 12 and terminate so as normally to be slightly above and in spaced relationship to the upper surface of the base plate 14. The elements 21 and the base plate 14, therefor, form a normally open electrical switch SW1. When, however, a person or some other object is on the treadle pad 12, the weight will urge the treadle pad downwardly so that the heads of elements 21 electrically contact the plate 14. Preferably, the treadle device 10** will respond to a pressure of about 2½ lbs. or more so as to be capable of sensing the presence of animals as well as humans.

If the treadle pad 12 is made of resinous plastic, it can be integrally formed with the upper plate 16 and the hinge 18, in which case, only the forward portion of the plate 14 located beneath the elements 21 need be electrically conducting.

Figure 4:
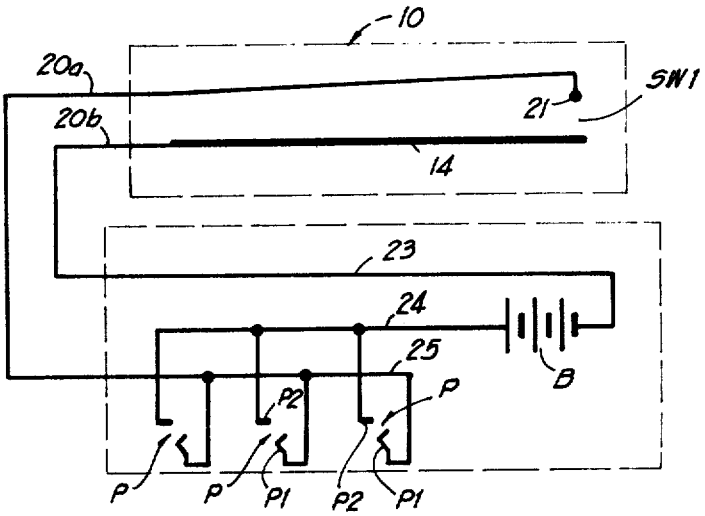
FIG. 4 is an electrical schematic showing the circuitry in the embodiment of FIG. 1.

Connected to the other end of the cable 20 is a hollow boxlike control unit or housing 22, within which are disposed a dry cell d.c. battery B (see FIG. 4). Of course, a plurality of small flashlight batteries may constitute this dry cell battery B, if desired. The boxlike unit 22 has flat rectangular walls as shown in FIG. 1.

The distal end of wire **20*b* is electrically connected through wire 23 to one terminal of the battery B. The other terminal of battery B is connected via wire 24 to the rear element P2 of each of a plurality of female plugs or sockets P. The distal end of wire 20*b* connected, via wire 25, to the spring biased other element P1** of the sockets or plugs P.

It is therefore seen that each of the sockets or plugs P are connected in parallel with each other and that the sockets or plugs P are in series with the normally open switch SW1 across battery B. The sockets or plugs P are mounted in spaced juxtaposition along one of the walls of the control unit 22 so that each plug P may removably receive a male plug 26 on the proximal end of a cable 27. The two elements of the male plug 26 are respectively connected to the proximal ends of two wires 27*a* and 27*b* in the cable 27. The distal ends of the two wires of cable 27 are connected to the two terminals of an audio or visual alarm device, such as a bell or buzzer 30. While I have employed a bell or buzzer 30 as an illustration of the alarm device, it will be understood by those skilled in the art that the alarm device 30 may be any other type of noise making device or may have incorporated therewith or as a substitute therefor a visual signaling device, such as a light flashing device.

Figure 5:
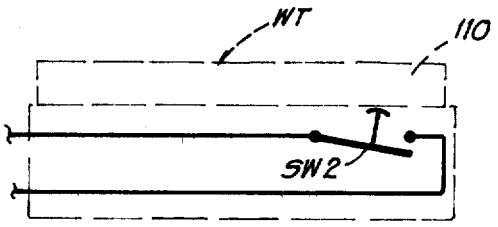
FIG. 5 is a schematic view of an alternate treadle.

In FIG. 5 it is seen that, if desired, the treadle switch can be a normally closed switch SW2, rather than the normally open switch SW1 formed by contacts 21 and 14. The purpose of such a normally closed switch SW2 is so that the treadle device or pad 110 can support a weight and will detect when the weight is removed. Thus, in the embodiment of FIG. 5 a weight is denoted by the letters WT, the weight being depicted as supported on the step pad 112. When such a weight WT is removed, switch SW2 is closed to actuate the signaling device, such as bell 30 through the control unit 20.

In operation, the treadle pad 10 is placed immediately outside or in front of a closed door. The cable 20 is laid beneath the door and the control unit 22 is placed inside or on the other side of the door. One or more alarm devices, such as bell 30, are plugged into the unit 22 by inserting the plug or plugs 26 into the socket or plugs P. This completes a circuit from the wire 24, via wires 27*a*, 27*b* and the bell 30 to wire 25. When the switch SW1 is closed by the weight of a person or an animal, the circuit is completed from the battery B to the bell 30 via the switch SW1 to actuate the bell 30.

The devices described herein are totally self contained and can be moved from place-to-place, as desired. If the device is to be employed to detect the removal of weight WT, the treadle pad 110 of FIG. 5 is substituted for the treadle pad 10 of FIG. 1.

It will be obvious to those skilled in the art that many variations may be made in the embodiments chosen for the purpose of illustrating the present invention without departing from the scope thereof as defined by the appended claims.

We claim:

1. An alarm device comprising:

(a) a readily movable treadle device having a pair of opposed upper and lower panels and a common hinge disposed along one edge, said common hinge yieldingly supporting one of said panels in spaced relationship above the other panel; the lower of said panels being disposed flat against an essentially horizontal supporting surface, the upper of said panels being disposed thereabove in essentially parallel relationship to the lower panel, said panels each being rectangular and generally of approximately the same size and shape for defining a pad on which a person steps;

(b) switch means having elements thereof connected respectively to said panels, said switch elements being disposed along the edge portions of said panels opposite to said common hinge;

(c) a cable leading from said treadle device, said cable having a pair of wires respectively connected to the elements of said switch means;

(d) a control unit, the other end of said cable being connected to said control unit;

(e) a battery disposed within said control unit, one of said wires of said cable being connected electrically to one of the terminals of said battery;

(f) socket means mounted in said control unit, the other wire of said cable being connected to one of the elements of said socket means, the other terminal of said battery being connected to the other element of said socket means; and (g) an alarm means connected to said socket means.

2. The alarm device defined in claim 1 wherein the upper one of said panels is a waffled flat rigid pad and the lower of said panels includes a flat sheet metal electrically conducting plate forming one of the elements of said switch means.

3. The alarm device defined in claim 2 wherein said hinge is integrally joined to said metal plate and is U-shaped along a transverse edge of said metal plate and wherein said hinge includes an upper plate disposed over the plate of the other panel and wherein said one panel includes a rigid rectangular treadle pad bonded to said upper plate, said treadle pad being supported in cantilever fashion by said upper plate.

4. The alarm device defined in claim 1 wherein said alarm device includes an electrically actuated alarm element and a cable extending from said electrically actuated alarm element, and a plug on the end of said cable, said plug being removably received in said socket means.

5. The apparatus defined in claim 1 wherein said socket means includes a plurality of spaced juxtaposed sockets mounted on the wall of said control unit, each of said socket means being adapted selectively to removably receive a plug therein, and wherein said alarm device includes a cable provided with a plug, said plug being removably received in one of said sockets and other electrically actuated alarm devices having plugs received by the other sockets.

* * * * *